US006931141B2

(12) United States Patent
Moller

(10) Patent No.: US 6,931,141 B2
(45) Date of Patent: Aug. 16, 2005

(54) HEARING AID AND A METHOD FOR OPERATING A HEARING AID

(75) Inventor: Finn Thoger Moller, Frederiksberg (DK)

(73) Assignee: GN Resound A/S (DK)

( * ) Notice: Subject to any disclaimer, the term of this patent is extended or adjusted under 35 U.S.C. 154(b) by 47 days.

(21) Appl. No.: 10/268,369

(22) Filed: Oct. 10, 2002

(65) Prior Publication Data

US 2003/0128855 A1 Jul. 10, 2003

(30) Foreign Application Priority Data

Oct. 12, 2001 (DK) ..... 2001 0154

(51) Int. Cl.[7] ..... H04R 25/00
(52) U.S. Cl. ..... 381/323; 381/314
(58) Field of Search ..... 381/323, 312, 381/314, 322, 23.1, 315, 324, 328

(56) References Cited

U.S. PATENT DOCUMENTS 4,532,930 A * 8/1985 Crosby et al. ..... 607/57
5,188,540 A * 2/1993 Haertl et al. ..... 439/500
5,404,407 A * 4/1995 Weiss ..... 381/314
6,144,748 A * 11/2000 Kerns ..... 381/312
6,449,662 B1 * 9/2002 Armitage ..... 710/8

FOREIGN PATENT DOCUMENTS

DE 29915874 U1 3/2000 ..... H04R/24/02

* cited by examiner

*Primary Examiner*—George Eng
*Assistant Examiner*—Brian Ensey
(74) *Attorney, Agent, or Firm*—Michael J. Bolan; Bingham McCutchen LLP

(57) ABSTRACT

A hearing aid comprising a housing with a connector enabling an external device to be connected thereto is provided. The connector includes a set of closely spaced electrical terminals operatively connected to at least one internal hearing aid component. The hearing aid also comprises detecting means adapted for determining whether an external device is connected or unconnected to the hearing aid, and the hearing aid is adapted for keeping the set of closely spaced electrical terminals at a substantially equal electrical potential during at least a part of the time periods wherein an external device is unconnected. A method of operating a hearing aid and a program comprising code adapted for operating a hearing aid is also provided.

12 Claims, 5 Drawing Sheets

HEARING AID AND A METHOD FOR OPERATING A HEARING AID

CROSS-REFERENCES TO RELATED APPLICATIONS

This application claims the benefit of Danish Patent Application Serial No. PA 2001 01504 filed Oct. 12, 2001, the specification of which is incorporated herein in its entirety for any and all purposes.

BACKGROUND OF THE INVENTION

Hearing aids often comprise a connector with a set of closely spaced electrical terminals operatively connected to one or more internal hearing aid components. Such connectors normally form part of the housing of the hearing aid and may be located at the outer surface or at least near the outer surface thereof. This location enables an external device to be connected to the hearing aid. As a result an external device may be operatively connected to the hearing aid via the connector of the hearing aid; e.g. using a cable including a plug adapted to engage with the connector.

In some hearing aids the terminals may form an electrical programming interface for an external computer or programming device or the terminals may form part of such an interface. Therefore prior to programming a programmable hearing aid, the external programming device to be used may be electrically connected to the hearing aid via the connector. Hereby an external programming device may be operationally connected to one or more internal components of the hearing aid, such as a processor and/or a memory device, and the hearing aid may be programmed, if desired.

In order to program a hearing aid the connector includes at least one electrical terminal adapted to form a data communication path between the external device and one or more internal components of the hearing aid during programming. The hearing aid may be supplied with setting data from the external programming device connected thereto, or the hearing aid may exchange data with the programming device.

Normally, the connector in a hearing aid comprises two or more electrical terminals which are connected to internal hearing aid components. For example, the set of electrical terminals of the connector may include one or more electrical power terminals and one or more terminals for data communication.

The type of hearing aid initially mentioned also includes other types of hearing aids than programmable hearing aids having a programming interface. For example, the terminals may form an external audio interface adapted to receive audio signals from e.g. a miniature FM receiver or other audio sources.

A hearing aid of the above-mentioned type may include detecting means adapted to determine whether an external device is connected to the hearing aid or not. Hereby, the hearing aid may for example be operated in different modes depending on whether an external device is connected to the hearing aid or not. For example, a programming hearing aid may be brought into a programming mode when the external programming device is connected thereto. Likewise, the hearing aid may again be brought into a predetermined mode of operation, e.g. a mode of normal operation, when an external device, such as a programming device, is no longer operationally connected to the hearing aid. During programming mode, the hearing aid may for example receive programming data specifying the signal processing to be performed during one or more modes of operation.

The patent publication U.S. Pat. No. 5,404,407 discloses a programmable hearing aid unit including electrical contacts for connecting a programming circuit of the hearing aid to an external programming unit via a programming socket at the housing.

Further, the German utility model publication DE 299 15 874 is an example of a programmable hearing aid having an electrical programming interface.

The terminals of a connector in a hearing aid are normally closely spaced as the terminals hereby may form part of a connector or socket as mentioned above. This is desirable as an interface having two or more closely spaced terminals enables the connection and disconnection of an external device to be performed easily, quickly and in a fail-safe manner. Furthermore, as hearing aids are unobtrusive, they are most often given miniature dimensions. Therefore, only a small amount of surface space is available for interfaces and the like on the surface of the hearing aid housing and the terminals must be closely spaced.

The drawback of placing the electrical terminals at or near the outer surface of the hearing aid has been found to be that the electrical terminals are unprotected from the external environment and as a result they are often subjected to corrosion. This is undesirable as corrosion makes connection to external devices unreliable and may at worst break the connection.

SUMMARY OF THE INVENTION

The object of the invention is to provide an improved hearing aid compared to the prior art.

According to the invention, the object is achieved by a hearing aid of the type initially mentioned characterized in that the detection means is adapted to keep said set of closely spaced electrical terminals at a substantially equal electrical potential during at least a portion of the time periods wherein the external device is unconnected. The wording closely spaced electrical terminals is to be read as electrical terminals located so that two neighboring electrical terminals have an internal distance preferably between 0.1 mm and 2.0 mm, even more preferably between 0.1 mm and 0.5 mm, and typically between 0.4 mm and 0.5 mm.

The invention is based on the fact that the electrical terminals of the hearing aid have been found to be subjected to corrosion as they are operated in an environment in which the terminals are often more or less covered by conducting fluids, e.g. due to the humidity or sweat from the user of the hearing aid. As the terminals in prior art hearing aids most often have different electrical potentials, an electrochemical circuit is formed which results in a galvanic corrosion of the terminals. The metallic electrical terminals corrode due to the galvanic coupling created by the electrolyte and the voltage difference between the terminals. Therefore by detecting the presence of an external device connected to said terminals and by supplying the terminals substantially the same electrical potential during periods wherein no external devices are connected to said terminals, or at least a major part of said periods, the corrosion problem is solved or at least reduced significantly.

Furthermore the solution according to the invention may be implemented without rearranging the terminals, i.e. the close-spacing of the terminals does not have to be changed compared to the terminal locations in hearing aids of the prior art, if desired. Hereby the advantages of the close-spacing location of the terminals according to the prior art may still be found in the hearing aids according to the invention. In addition the solution may easily be implemented in both existing and newly developed hearing aids.

In a preferred embodiment of a hearing aid according to the invention, the detecting means is responsive to an electrical signal, such as a DC or AC voltage, supplied by the external device. Based on the electrical signal supplied to the hearing aid the detection means may be adapted to sense whether an external device is connected to the hearing aid or not. This is a space saving solution as it does not require additional electrical terminals or mechanical detection means at the outer surface of the hearing aid. In addition, the operation does not require any special action from a user due to the automatically detection, and hereby a fail safe operation is ensured.

In a preferred embodiment of a hearing aid according to the invention, the detecting means comprises a comparator responsive to said electrical signal. Preferably, the comparator includes a MOS transistor to which gate terminal said electrical signal is supplied. This embodiment is advantageous due to the simplicity and due to the fact that it may form a compact, space saving implementation in a hearing aid.

In an alternative embodiment the hearing aid includes mechanical detecting means. This solution may be advantageous in some hearing aids.

Preferably the set of closely spaced electrical terminals is kept at a substantially equal electrical potential during substantially entire time periods wherein the external device is unconnected. Hereby, a maximal suppression of the undesired corrosion of the terminal is obtained.

According to a preferred embodiment said set of closely spaced electrical terminals forms part of a programming interface or an audio connector between the external device and the hearing aid.

The invention also relates to a hearing aid comprising a housing, at least one internal hearing aid component, and a programming interface connector comprising a set of closely spaced electrical terminals operatively connected to said at least one internal hearing aid component, said set of electrical terminals being electrically connectable to an external device, and a voltage setting means adapted for keeping said set of closely spaced electrical terminals at a substantially equal DC-voltage.

Hereby, the above-mentioned corrosion problem is solved or at least reduced significantly. Further the solution according to the invention may be implemented in hearings aids at a relatively low cost.

Preferred embodiments according to the invention are defined by claims 10 and 11.

Furthermore, the invention relates to a method of operating a hearing aid comprising a connector with a set of closely spaced electrical terminals operatively connected to at least one internal hearing aid component and electrically connectable to an external device, said method comprising the steps of detecting whether the external device is connected or unconnected to the hearing aid, and keeping said set of closely spaced electrical terminals at a substantially equal electrical potential during at least a portion of a time period corresponding to the external device being unconnected from the hearing aid.

Hereby the same advantages are achieved as mentioned in relation to the independent hearing aid claim above.

A further understanding of the nature and advantages of the present invention may be realized by reference to the remaining portions of the specification and the drawings.

DESCRIPTION OF THE SPECIFIC EMBODIMENTS

Figure 1A:
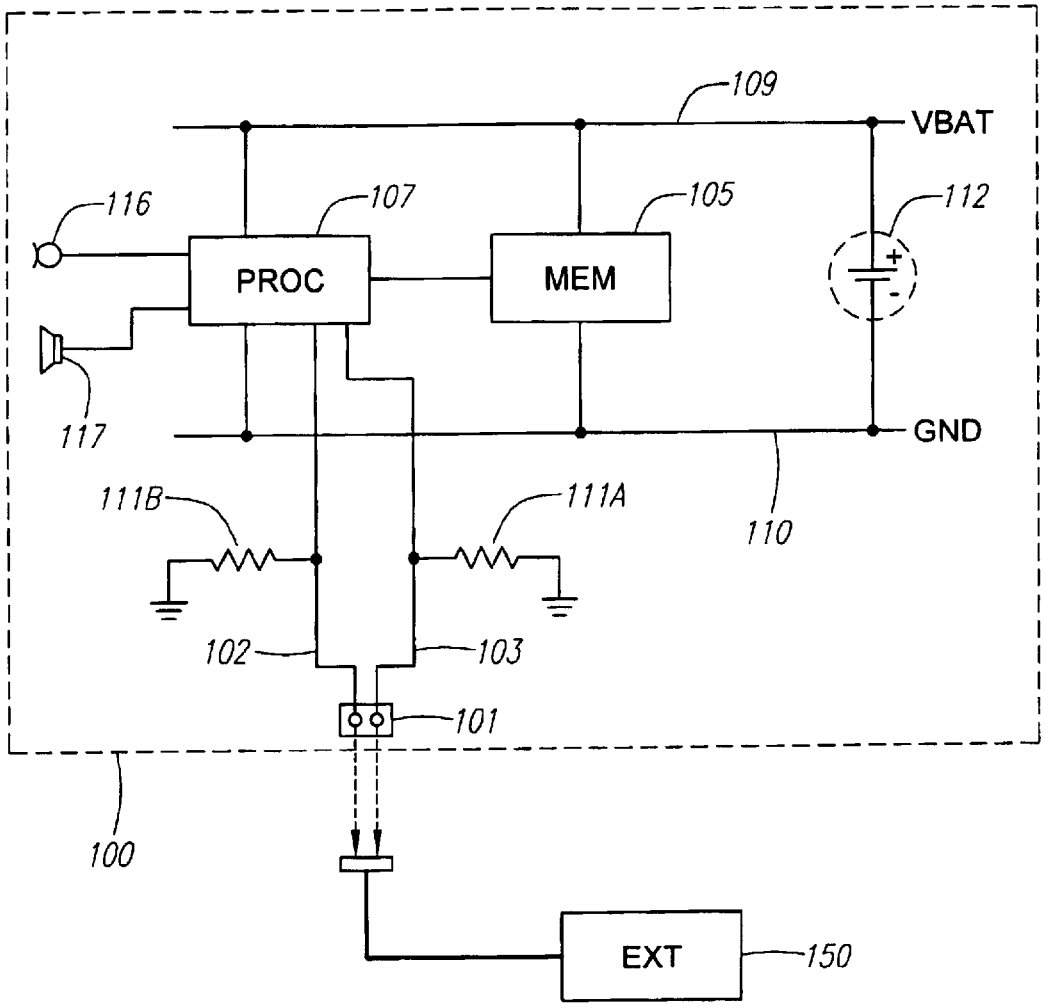
FIG. 1A is a first example of a hearing aid according to the invention.

FIG. 1A is an example of a hearing aid according to the invention. The hearing aid 100 shown includes an acoustic-electro transducer 116, a processor 107, a memory 105, and a speaker 117. As shown in the figure the acoustic-electro transducer or microphone 116 is normally connected to the speaker 117 via the processor 107. During normal operation an acoustic signal is received via the microphone 116 and an electrical signal representing the received signal is supplied to the processor 107. The processor 107, e.g. a digital signal processor or DSP, is adapted for processing the signal received from the microphone 116 and to generate a signal which is supplied to a user of the hearing aid 100 via the speaker 117. The processor 107 is normally connected to the memory 105 which may include information to be used by the processor 107 in order to perform the desired data processing. Therefore the memory 105 may include both general and user-related processing information as well as other data.

The hearing aid 100 comprises a housing (not shown) and a number of internal hearing aid components which are located within the hearing aid housing. In the example shown, the internal components include the memory 105, and the processor 107 and a battery 112. In the shown example, the battery 112 is connected to the processor 107 and the memory 105 via electrical connections 109, 110. Furthermore the hearing aid 100 comprises a connector 101 with a number of electrical terminals adapted for being electrically connected to an external device 150. In the example shown the connector 101 includes two electrical terminals 102, 103.

In order to form a connector 101, the set of electrical terminals 102, 103 is closely spaced, i.e. the terminals 102, 103 have a relative small internal distance. The distance between the two neighboring electrical terminals 102, 103 in a hearing aid connector 101 may vary from hearing aid to hearing aid but it is preferably between 0.1 mm and 2.0 mm, even more preferably between 0.1 mm and 0.5 mm, and typically between 0.4 mm and 0.5 mm. The electrical terminals 102, 103 of the connector 101 form a set of terminals as they are operatively connected to one or more co-operating internal hearing aid components. The connector 101 is adapted for enabling an external device 150 to be electrically connected to the electrical terminals 102, 103. Hereby an external devise 150, such as a programming unit, may be connected to one or more internal components of the hearing aid 100, such as the processor 107 and the battery 112, and may for example perform a programming of the hearing aid 100.

Normally a hearing aid includes two or more connector terminals each being connected to one or more internal electrical components. A programming interface may for example use a serial data transmission using two or more electrical connections or terminals. In the example shown, first electrical terminal 102 and the second electrical terminal 103 are both connected to the processor 107. For example, the first and the second electrical terminal may be used as a data terminal and a clock terminal, or as a data terminal and a ground potential terminal. In other embodiments of hearing aids according to the invention, the first electrical terminal 102 and/or the second electrical terminal 103 could be connected to other internal hearing aid components, such as the memory 105.

In hearing aids according to the prior art one or more internal hearing aid components have been connected to the connector terminals and therefore both DC and AC voltage was supplied to the connector terminals during use. For example, a data communication line between a processor or a memory device, may be connected to a connector terminal.

The hearing aid 100 according to the invention includes first and second voltage setting means adapted for controlling the DC-voltages on the electrical terminals 102, 103. In the shown embodiment the first voltage setting means is implemented as a pull-down resistor 111A connected between the terminal 103 and a predefined potential, such a ground potential. Likewise, the second voltage setting means is implemented as a pull-down resistor 111B connecting the terminal 102 to the ground potential. Hereby, the closely spaced electrical terminals are kept at a substantially equal DC-voltage during most of the time in which the hearing aid is operated. Other voltage setting means may be used as well. The use of pull-up resistors is another example of a simple implementation of a voltage setting means to be used.

Figure 1B:
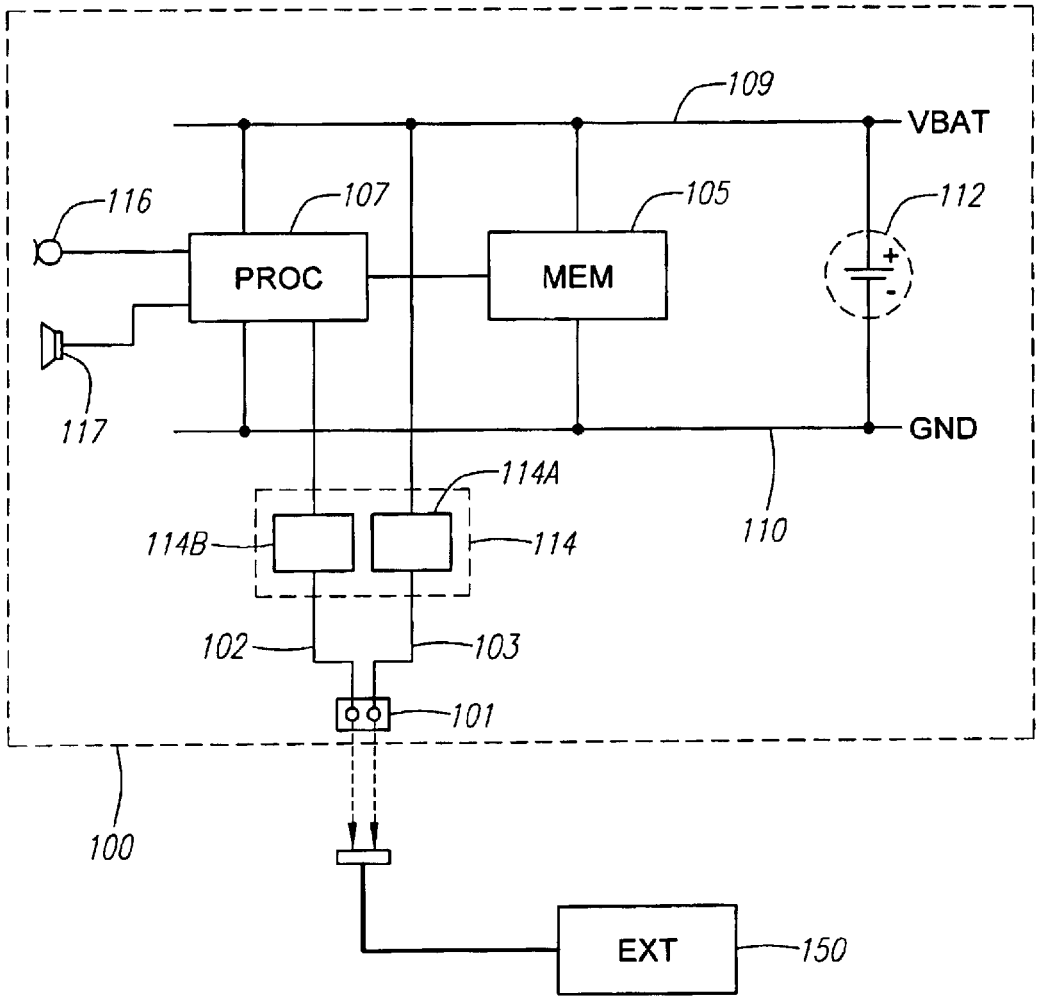
FIG. 1B is a second example of a hearing aid according to the invention.

FIG. 1B is another example of a hearing aid according to the invention. As some parts of the hearing aid in FIG. 1B are similar or identical to the corresponding parts of the hearing aid illustrated in FIG. 1A, these parts are given the same reference numbers as used in FIG. 1A. The hearing aid illustrated in FIG. 1B includes a microphone 116, a processor 107, a loudspeaker 117, a memory 105, a battery 112, and a connector 101 having two electrical terminals 102, 103. The electrical terminals are connected to internal hearing aid components and are connectable to an external device 150 via the connector 101.

In the example shown the first electrical terminal 102 and the second terminal 103 are connected to the processor 107 and to the electrical connection 109, respectively. Hereby an external power source may provide the hearing aid with electrical power during a programming session and ensures that a sufficient power level is present in the hearing aid. As a result a desired power level is ensured to be present in the hearing aid. Further, the hearing aid may be operated both with and without a battery.

As described below, the shown hearing aid includes detecting means 114 adapted for detecting whether an external device 150 is connected or unconnected to the hearing aid 100, and the hearing aid 100 is adapted for keeping the closely spaced electrical terminals 102, 103 at a substantially equal electrical potential during at least a part of the time periods wherein the external device 150 is not connected to the hearing aid 100. For example, this solution is advantageous over the use of voltage setting means in the form of a pull-down or pull-up resistor when one ore more of the electrical terminals 102, 103 of the connector 101 are connected to an internal power source 112.

When the hearing aid 100 detects that an external device 150 has been connected thereto via the electrical terminals 102, 103, the hearing aid 100 may change the mode of operation from a mode of normal operation to another mode. For example, when an external programming device is connected to a programmable hearing aid, the hearing aid mode may change to a programming mode wherein the hearing aid is supplied with programming data from the external programming device 150 connected thereto, or the hearing aid 100 may exchange data with the programming device 150. In other words, in the programming mode data may be transmitted between a hearing aid 100 and an external device 150 via a communication path established between the external device and one or more internal hearing aid components via the connector 101.

Likewise the detection means 114 of the hearing aid 100 is also adapted to determine when the external device 150 is disconnected from the hearing aid 100. Hereby, the mode of operation of the hearing aid 100 may automatically be changed from a programming mode to the mode of normal operation in which all the connector terminals are supplied with substantially the same electrical potential. This will be described more fully below. As illustrated in the figure a hearing aid 100 may include a plurality of detection means 114A, 114B or only a single detection means 114. Further the detection means may not be located in a single component but may as well be located in a number of co-operating parts of the hearing aid, e.g. the processor may perform some of the described detection means functions or operations, whereas other operations may be performed by other parts of the hearing aid.

The detection means 114 may be implemented in a number of different ways and some examples are given below.

Figure 2A:
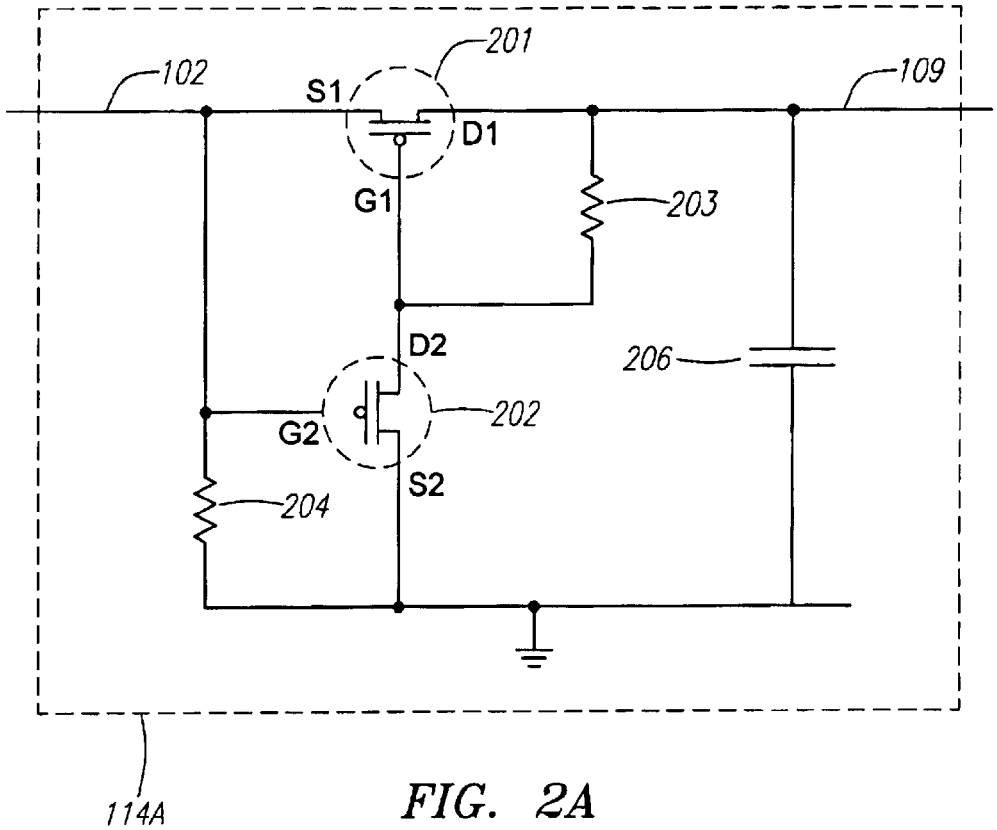
FIG. 2A is an electrical detection means.

FIG. 2A is a first example of a detection means 114A adapted for detecting whether an external electrical signal is supplied thereto and which is further adapted for keeping an electrical terminal at a substantially equal electrical potential during the time periods wherein an electrical signal is not supplied thereto, i.e. during the time periods wherein an external device is not connected to the hearing aid. It should be noted that keeping the electrical terminals of the connector at a substantially equal electrical potential also includes the embodiment wherein the connector terminals are disconnected from the internal devices of the hearing aid, i.e. disconnected from electrical signal or electrical power supplying devices.

The detection means shown may for example be adapted for detecting whether an electrical power signal is supplied on an electrical terminal such as the terminal 102 of the connector 101 shown in FIG. 1B. Therefore the detection means shown is supplied with the reference number 114A as in FIG. 1B.

As indicated in FIG. 2A, the detection means 114A may include a first electrical terminal 102 which is connected to a second electrical terminal 109, such as an electrical power terminal 109, via a first transistor 201. The detection means 114A includes a first and a second transistor 201, 202. The first transistor 201 is a p-type MOS transistor having the source terminal (S1) and the drain terminal (D1) connected to the first terminal 102 and the second terminal 109, respectively. The second terminal 109 is adapted for supplying a high electrical potential (VBAT) of a power source, such as a battery 112 as described in FIG. 1B, for example. The gate terminal (G1) of the first transistor 201 is connected to the second electrical terminal or electrical power terminal 109 via a first resistor 203. In the example shown the gate terminal (G1) of the first transistor 201 is connected to a predefined ground potential (GND) via a second transistor 202. In the example shown, the second transistor 202 is an n-type MOS transistor having the drain (D2) terminal and the source terminal (S2) connected to the gate terminal (G1) of the first transistor 201 and GND, respectively. The gate terminal (G2) of the second transistor 202 is connected to the electrical terminal 102. Further the gate terminal (G2) of the second transistor 202 is connected to GND via a second resistor 204. Finally, as illustrated in the figure, the detection means 114A may include a decoupling capacitor 206. It is noted that the use of MOS transistors is a specific embodiment of the use of comparators. In other words other comparators may also be used according to the invention.

The function of the detection means 114A may be described as follows. When a voltage lower than the gate-to-source voltage threshold voltage of the second transistor 202 is supplied to the first terminal 102, e.g. when no external electrical device is connected thereto, the second transistor 202 is off disconnecting source terminal (S2) and the drain terminal (D2). As a consequence the potential VBAT may be found at the drain terminal (D2) of the second transistor 202, as substantially no current will flow through the resistor 203. In this situation the first transistor 201 will be off. On the other hand, when a voltage higher than the gate-to-source voltage threshold of the second transistor 202 is supplied to the first terminal 102, i.e. when a sufficient high electrical potential is present at the terminal 102, the second transistor 202 is on. As a consequence a potential substantially equal to GND may be found at the drain terminal (D2) of the second transistor 202. In this situation the first transistor 201 will act as a connected switch between the source terminal (S1) and the drain terminal (D1) thereof D2 acts as a comparator with a threshold voltage of 0.5–0.8 V, for example. Other voltage levels are also possible.

Therefore the detection means 114A illustrated in FIG. 2A is adapted for connecting and disconnecting a first terminal 102 and a second terminal 109 in accordance with the voltage occurring on the first terminal 102. In other words, the detection means 114A is adapted for detecting the absence of a sufficiently high voltage on the terminal 102 and as a result the terminal 102 and the terminal 109 will be kept disconnected. Further the detection means 114A will detect the presence of a sufficiently high voltage on the terminal 102, and as a result the first terminal 102 and the second terminal 109 will be kept connected. Therefore the detection means 114A may act as a switch connecting and disconnecting a terminal located at the outer surface of a hearing aid to and from an internal component of the hearing aid, e.g. a battery power terminal. Further the detection means may be responsive to an AC and DC voltage supplied thereto by an external device.

In practice the terminal 102 may advantageously be connected to GND via a pull-down resistor (not shown) as the terminal voltage hereby may be kept at a well-defined level during periods wherein no external voltage is supplied thereto, e.g. when no external signal or power supplying devices are connected thereto. For example, the pull-down resistor may have a resistance in the interval of 100–200 kW but other values may also be selected. Further, in some embodiments a pull-up resistor may be used instead of the above-mentioned pull-down resistor.

Figure 2B:
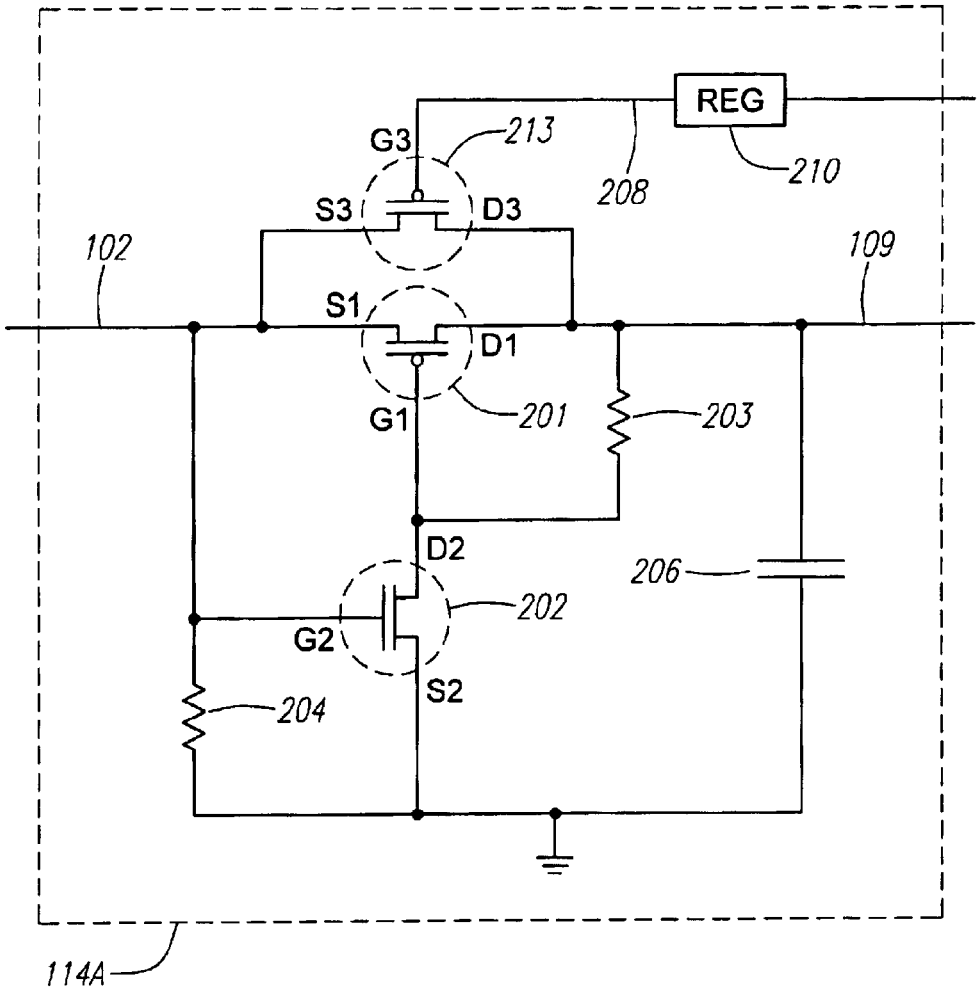
FIG. 2B is another electrical detection means.

FIG. 2B is a second example of a detection means adapted for detecting whether an external electrical signal is supplied thereto and which is further adapted for keeping an electrical terminal at a substantially equal electrical potential during at least a art of time periods wherein an electrical signal is not supplied thereto.

In addition to the components described in relation to FIG. 2A, the detection means shown in FIG. 2B includes a third transistor 213. The third transistor 213 shown is a MOS transistor having the source terminal (S3) and the drain terminal (D3) connected to the first terminal 102 and the second terminal 109, respectively. The gate terminal (G3) of the third transistor 213 is connected to a control terminal 208. Hereby the connection and disconnection of the first and the second terminal 102, 109 may also be controlled by use of a control signal supplied by the control terminal 208. As shown in the figure the detection means may for example be supplied to the transistor from a register (REG) 210 which may be located in the processor 107 of the hearing aid 100, for example.

As described the detection means 114 may perform the operation of supplying a terminal with a predefined potential when no external devices are connected to the hearing aid. Alternatively this operation may also be performed by other components of the hearing aid. For example, one or more component adapted for receiving information from the detection means about external devices connected or disconnected to the hearing aid may operate as a switch connecting or disconnecting the connector terminals and the internal components of the hearing aid. Further the detection means 114 and/or the means adapted for keeping the closely spaced electrical terminals 102, 103 at a substantially equal electrical potential may form part of other components of the hearing aid, e.g. the processor 107.

Figure 3:
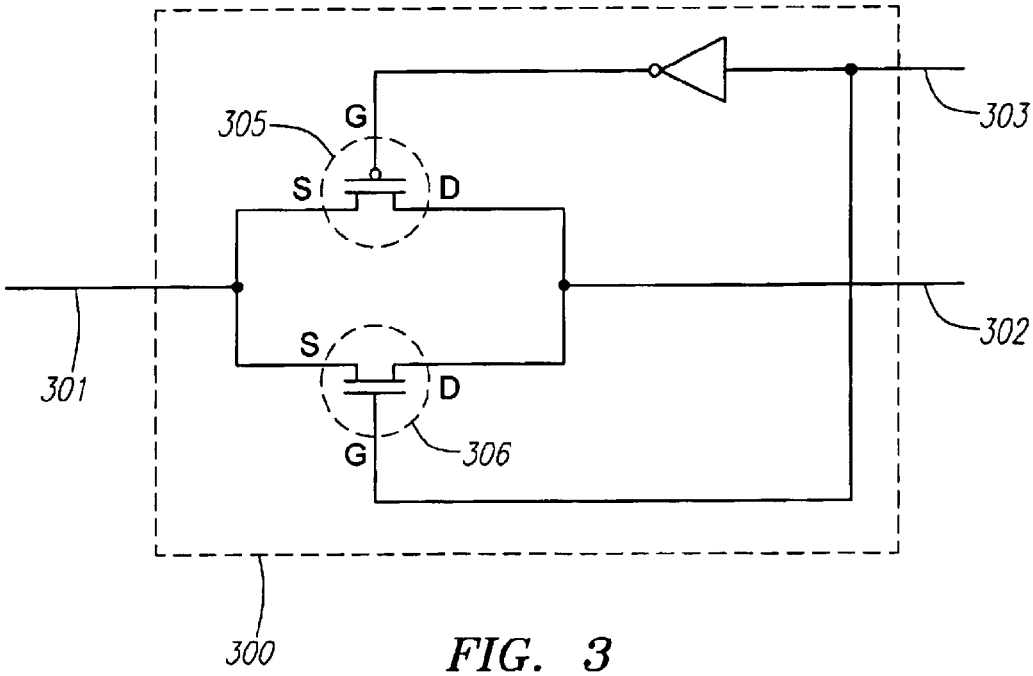
FIG. 3 (PRIOR ART)
FIG. 3 is a controllable switch.

FIG. 3 is another example of a circuit adapted for keeping the set of closely spaced electrical terminals at a substantially equal electrical potential during the time periods wherein an external device is not connected to the hearing aid 100.

The circuit 300 is a well-known transmission gate adapted for connecting or disconnecting a first terminal 301 and a second terminal 302 depending on a control signal supplied thereto via a control terminal 303; i.e. the circuit 300 is adapted for operating as a controllable switch.

As in FIGS. 2A and 2B, the terminal 301 may advantageously be connected to a well-defined potential, e.g. a ground potential, via a pull-down resistor as the terminal voltage hereby may be kept at a well-defined level during periods wherein no external voltage is supplied thereto. Hereby the switch 300 may form part of a hearing aid according to the invention. For example, the switch 300 may form part of the detection means denoted 114B and the detection means described in FIG. 2A or FIG. 2B may be used as the detection means 114B in FIG. 1B. The control signal supplied to control terminal 303 of the switch 300 may for example be controlled by a signal level detector which is activated when the signal level on the electrical terminal 103 exceeds a predefined level. Hereby, when a signal such as a data signal or a power input is present on a connector terminal, such as the terminal 102 or the terminal 103, the switch is activated, i.e. a connector terminal may be connected to one or more internal hearing aid components. Alternatively the control terminal 103 may form part of the connector 101 whereby the operation thereof may be controlled externally. Hereby, the switch 300 may connect an connector terminal, such as terminal 103 to the processor 107, when the connection is requested by an external device 150, only. The request may for example be performed by applying a control signal to the control terminal 103. The detecting means may be responsive to a DC or an AC voltage supplied by the external device.

Figure 4:
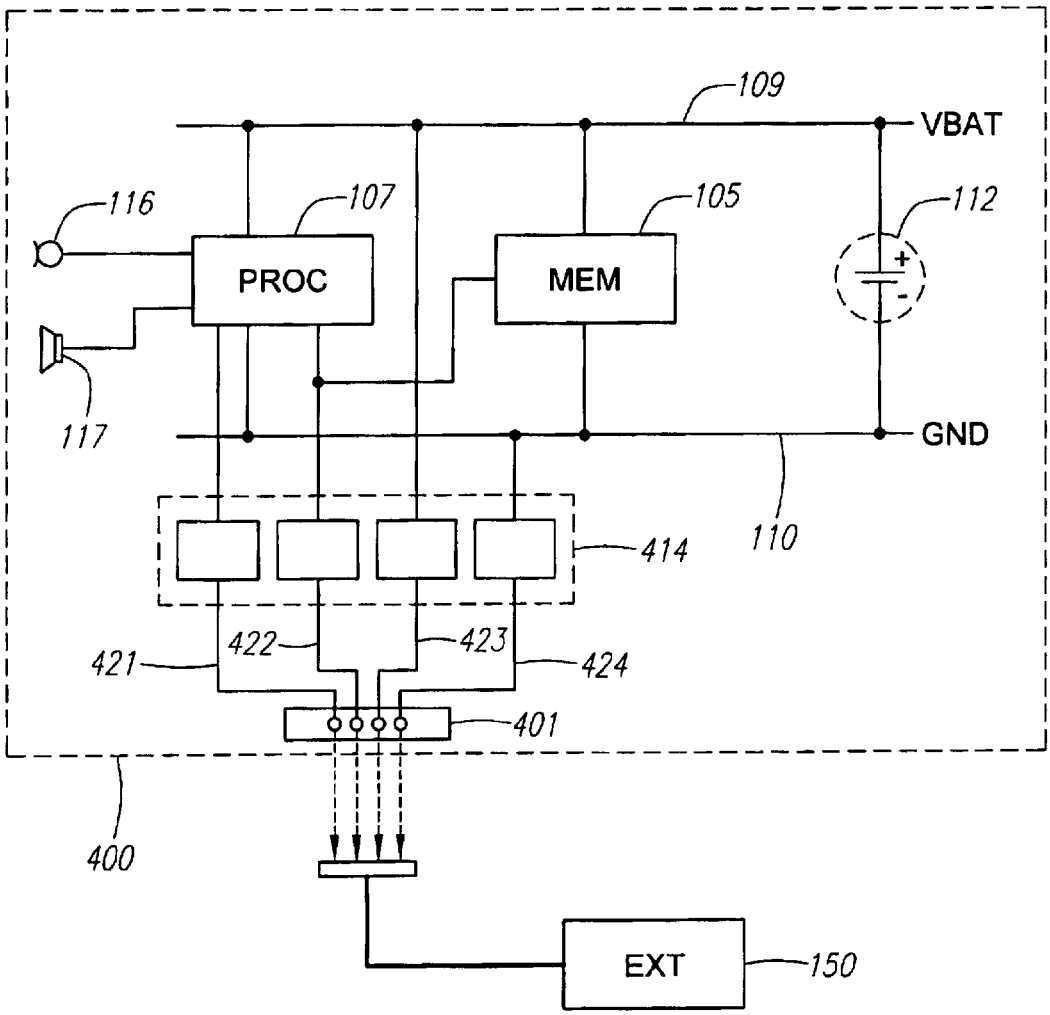
FIG. 4 is a third example of a hearing aid according to the invention.

FIG. 4 is a second example of a hearing aid according to the invention. The hearing aid 400 includes a connector 401 having four electrical terminals 421, 422, 423 and 424. The first terminal 421 and the third terminal 423 is connected to the processor 107 and to the electrical power terminal 109 via a detection means 414, and therefore these terminals may correspond to the first terminal 102 and the second terminal 103 of FIG. 1B, respectively. In addition to these terminals the hearing aid 400 includes a second terminal 422 and a fourth terminal 424. The second terminal 422 is also connected to the processor 107 via the detection means 414 and may for example be adapted for supplying an external clock signal to the processor 107. The fourth terminal 424 is connected to the power terminal 110. For example, the four electrical terminals may be used as a data terminal, a clock terminal, and a first and a second electrical potential terminal e.g. supplying GND and VBAT to the hearing aid. The figure illustrates that a connector of a hearing aid according to the invention may include more than two terminals. In fact the connector of a hearing aid according to the invention may include an arbitrary number of terminals.

The detection means 414 may be implemented in different ways for example as illustrated in FIG. 2A and FIG. 2B where the connection or disconnection are controlled on basis of the signal sensed on one or more connector terminals, or as in FIG. 3 wherein the connection or disconnection is controlled by use of a control signal supplied thereto via a control terminal 303. For example, the control terminal 303 may be connected to the processor 107 whereby the controlling of the switch 300 may be performed by the processor, e.g. depending on which state the processor 107 is operated. For example, if the processor 107 and the memory 105 are connected to each other and to a terminal of the connector 401, as shown in FIG. 4, the switch 300 may be instructed to disconnect when internal data are transmitted between the processor 107 and the memory 105, whereas it may be instructed to connect when data are to be transmitted to or from an external device via the connector 401. The instruction of the switch may also be derived from the presence of signals on one or more connector terminals or in other ways, e.g. when an external mechanical switch indicating a programming mode is activated externally.

Figure 5:
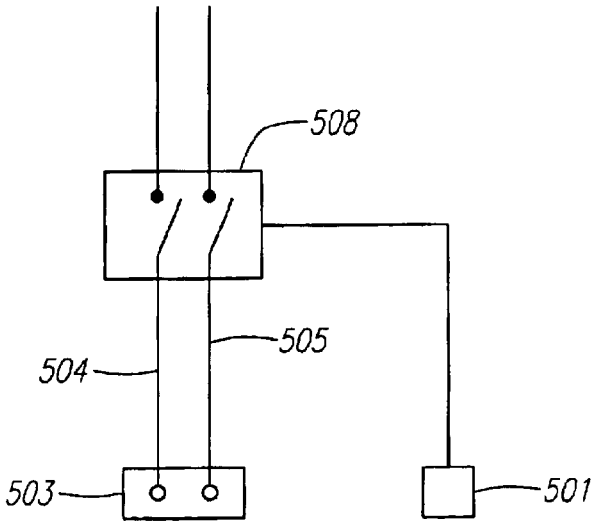
FIG. 5 is a mechanical detection means.

FIG. 5 is an example of a mechanical detection means 501 adapted for detecting whether an external electrical device is connected to a hearing aid, and which is further adapted for keeping an electrical terminal at a predefined electrical potential during the time periods wherein an external device is not connected to the hearing aid.

The mechanical detection means shown is a switch 501 which may be activated when an external device is connected to a hearing aid via a connector 503 having two or more electrical terminals 504, 505. For example, the switch 501 positioned in such a way that it is activated automatically when a plug or the like is engaged with a connector 503 of the hearing aid, and hereby the switches of a switching means 508 are connected, i.e. the connector terminals 504, 505 are connected to one or more internal hearing aid components. Likewise the connector terminals 504, 505 may be disconnected from the internal hearing aid components when switch 501 is deactivated.

In another embodiment the switch 501 may be activated by a user prior to the desired use of the connector 503. In another embodiment the switch 501 may be connected to the processor of the hearing aid and hereby the processor may use the input therefrom to select the mode of operation as mentioned above. Alternatively the switch 501 may be connected as a control signal to a connection/disconnection device, e.g. the circuit 300 shown in FIG. 3. Other mechanical detection means 501 may be used in connection with a hearing aid according to the invention, if desired.

The invention also relates to a method of operating a hearing aid comprising a connector with a set of closely spaced electrical terminals operatively connected to one or more internal hearing aid components and electrically connectable to an external device. The method comprises the step of detecting whether an external device is connected or unconnected to the hearing aid. The detection may be performed in different ways, e.g. as described above in relation to a hearing aid according to the invention. The method further includes keeping said set of closely spaced electrical terminals at a substantially equal electrical potential during at least a part of time periods wherein an external device is unconnected; i.e. when no external devices are connected to the hearing aid. When, on the other hand, an external device is operatively connected to one or more internal hearing aid components via the connector, the hearing aid may for example receive and/or transit data via the electrical terminals of the connector. The method or at least a part thereof may be executed by the processor of the hearing aid; i.e. the hearing aid includes processor executable program code adapted for performing at least a part of the above-mentioned method when run by a processor in a digital hearing aid. For example, when it is determined that an external device has been connected to the hearing aid, an interrupt request may be supplied to the processor of the hearing aid indicating that the hearing aid is to be operated in a first predefined mode of operation, e.g. at programming mode. Likewise when it is determined that an external device has been disconnected from the hearing aid, another interrupt request may be supplied to the processor indicating that the hearing aid is to be operated in a second predefined mode of operation, e.g. at mode of normal hearing aid operation, and the connector may for example be instructed to disconnect by supplying a control signal thereto.

Due to the fact that a preferred embodiment of the invention has been illustrated and described herein it will be apparent to those skilled in the art that modifications and improvements may be made to forms herein specifically disclosed. For example, the type of interface formed by the electrical terminals of the connector is of minor interest, as the problem according to the invention occurs in a variety of prior art hearing aids including electrical connector terminals. Further the hearing aids shown include a connector forming part of a programming interface but the connector may also be used for other purposes, if desired. The connector may for example be adapted for transmitting and/or receiving other signals such as audio signals to and/or from an external device when such a device is connected thereto, e.g. via an audio shoe connected to the hearing aid via the connector terminals. Further a hearing aid may include one or more detecting means, and one or more electrical and/or mechanical means adapted for keeping the connector terminals of the hearing aid at substantially the same potential. Further, in some embodiments the hearing aid according to the invention may act as a master when determining whether an external devise is connected thereto or not. For example, the detection means may output a low duty-cycle pulse signal to one or more of the electrical terminals 102, 103 and sensing impedance changes, e.g. by measuring amplitude changes in the pulse signal. In other embodiments the hearing aid may act as a slave, e.g. being instructed in which time periods the electrical terminals of the connector are to be kept at the same or approximately the same electrical potential. For example an AC signal, an DC signal, an optical signal my be supplied to the hearing aid as an instruction signal. Accordingly the scope of the present invention is defined by the appended claims rather than the forgoing described embodiments.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. A hearing aid comprising:

a housing comprising a connector with a set of closely spaced electrical terminals operatively connected to at least one internal hearing aid component, said set of electrical terminals being electrically connectable to an external device; and detecting means adapted to determine whether the external device is connected or unconnected to the bearing aid, said detecting means adapted for controlling said set of closely spaced electrical terminals so as to keep said set of closely spaced electrical terminals at a substantially equal electrical potential during at least a portion of a time period corresponding to the external device being unconnected from the hearing aid.

2. The hearing aid according to claim 1, wherein the detecting means is responsive to an electrical signal supplied by the external device, wherein the electrical signal is selected from the group consisting of a DC voltage signal, an AC voltage signal or another signal.

3. The hearing aid according to claim 2, wherein the detecting means further comprises a comparator responsive to said electrical signal.

4. The hearing aid according to claim 3, wherein said comparator further comprises a MOS transistor, wherein said electrical signal is supplied to a gate terminal of said MOS transistor.

5. The hearing aid according to claim 1, wherein the detecting means further comprises a mechanical detecting means.

6. The hearing aid according to claims 1, 2, 3, 4 or 5, wherein said set of closely spaced electrical terminals is kept at said substantially equal electrical potential throughout said time period.

7. The hearing aid according to claims 1, 2, 3, 4, or 5, wherein said set of closely spaced electrical terminals forms a portion of a programming interface connector between the external device and the hearing aid.

8. The hearing aid according to claims 1, 2, 3, 4, or 5, wherein said set of closely spaced electrical terminals forms a portion of an audio connector between the external device and the hearing aid.

9. A hearing aid comprising:

a housing;

at least one internal hearing aid component;

a programming interface connector comprising:

a set of closely spaced electrical terminals operatively connected to said at least one internal hearing aid component, said set of electrical terminals being electrically connectable to an external device; and a voltage setting means adapted for keeping said set of closely spaced electrical terminals at a substantially equal DC-voltage.

10. The hearing aid according to claim 9, said voltage setting means further comprising pull-up or pull-down resistors.

11. The hearing aid according to claim 9, further comprising a detecting means adapted to determine whether said external device is connected or unconnected to the hearing aid, said detecting means adapted for controlling said voltage setting means so as to keep said set of closely spaced electrical terminals at a substantially equal electrical potential during at least a portion of a time period corresponding to the external device being unconnected from the hearing aid.

12. A method of operating a hearing aid comprising a connector with a set of closely spaced electrical terminals operatively connected to at least one internal hearing aid component and electrically connectable to an external device, said method comprising the steps of:

detecting whether the external device is connected or unconnected to the hearing aid; and keeping said set of closely spaced electrical terminals at a substantially equal electrical potential during at least a portion of a time period corresponding to the external device being unconnected from the hearing aid.

* * * * *

UNITED STATES PATENT AND TRADEMARK OFFICE

CERTIFICATE OF CORRECTION

PATENT NO. : 6,931,141 B2
DATED : August 16, 2005
INVENTOR(S) : Finn Thoger Moller It is certified that error appears in the above-identified patent and that said Letters Patent is hereby corrected as shown below:

Column 3,
Lines 13-14, replace "due to the automatically detection," with -- due to automatic detection, --.

Column 5,
Lines 23-24, replace "such a ground potential." with -- such as a ground potential. --.

Column 6,
Line 44, replace "from electrical signal or" with -- from electrical signals or --.

Column 7,
Lines 65-66, replace "during at least a art of time" with -- during at least a part of time --.

Column 11,
Line 16, replace "bearing aid," with -- hearing aid, --.

Signed and Sealed this

Twenty-first Day of March, 2006

JON W. DUDAS
*Director of the United States Patent and Trademark Office*